US008695356B2

(12) United States Patent
Gan et al.

(10) Patent No.: US 8,695,356 B2
(45) Date of Patent: Apr. 15, 2014

(54) PULSE TUBE CRYOCOOLER MODULATING PHASE VIA INERTANCE TUBE AND ACOUSTIC POWER AMPLIFIER THEREOF

(75) Inventors: Zhihua Gan, Hangzhou (CN); Bo Wang, Hangzhou (CN); Limin Qiu, Hangzhou (CN); Longyi Wang, Hangzhou (CN); Bingyan Fan, Hangzhou (CN)

(73) Assignee: Zhejiang University, Zhejiang Province (CN)

( * ) Notice: Subject to any disclaimer, the term of this patent is extended or adjusted under 35 U.S.C. 154(b) by 200 days.

(21) Appl. No.: 13/381,500

(22) PCT Filed: Mar. 12, 2010

(86) PCT No.: PCT/CN2010/071028

§ 371 (c)(1), (2), (4) Date: Dec. 29, 2011

(87) PCT Pub. No.: WO2011/000228

PCT Pub. Date: Jan. 6, 2011

(65) Prior Publication Data

US 2012/0102976 A1 May 3, 2012

(30) Foreign Application Priority Data

Jun. 29, 2009 (CN) ..... 2009 1 0100287

(51) Int. Cl.
*F25B 9/00* (2006.01)

(52) U.S. Cl.
USPC ..... 62/6

(58) Field of Classification Search
USPC ..... 62/6, 215, 228.1, 259.2
See application file for complete search history.

(56) References Cited

U.S. PATENT DOCUMENTS

| | | | | |
|---|---|---|---|---|
| 5,412,952 | A * | 5/1995 | Ohtani et al. | 62/6 |
| 6,983,610 | B1 | 1/2006 | Olson | |
| 2007/0000257 | A1 * | 1/2007 | Mita et al. | 62/6 |

FOREIGN PATENT DOCUMENTS

| | | | |
|---|---|---|---|
| CN | 2811865 | Y | 8/2006 |
| CN | 2884056 | Y | 3/2007 |

* cited by examiner

*Primary Examiner* — Melvin Jones
(74) *Attorney, Agent, or Firm* — Jacobson Holman PLLC; Jiwen Chen

(57) ABSTRACT

A pulse tube cryocooler modulating phase via an inertance tube and an acoustic amplifier (A1, A2) provided in the pulse tube cryocooler are disclosed. The acoustic power amplifier (A1, A2) is made of a metal pulse tube (PT1, PT2) filled with regenerative materials, which are located at a distance of X from the hot end of the pulse tube. The length of the regenerative materials is L which meets the requirement of X−L>0. The acoustic power amplifier (A1, A2) can be used not only in a single-stage pulse tube cryocooler, but also in a multi-stage pulse tube cryocooler thermally coupled or gas coupled. The regenerative materials may be any cold storage materials applicable at low temperatures, such as stainless steel wire mesh, lead pellet, lead thread et al. The acoustic power amplifier (A1, A2) can increase the acoustic power at the hot end of the pulse tube (PT1, PT2), which is advantageous to the phase modulation of the inertance tube, thereby the properties of the pulse tube cryocooler can be enhanced.

4 Claims, 3 Drawing Sheets

( a )

(b )

(a)

(b)

PULSE TUBE CRYOCOOLER MODULATING PHASE VIA INERTANCE TUBE AND ACOUSTIC POWER AMPLIFIER THEREOF

This is a U.S. national stage application of PCT Application No. PCT/CN2010/071028 under 35 U.S.C. 371, filed Mar. 12, 2011 in Chinese, claiming the priority benefit of Chinese Application No. 200910100287.4, filed Jun. 29, 2009, which is hereby incorporated by reference.

TECHNICAL FIELD OF THE INVENTION

The present invention includes an acoustic power amplifier and a pulse tube cryocooler with inertance tube phase modulation, especially an acoustic power amplifier used in the modulating phase via inertance tube and a pulse tube cryocooler with the acoustic power amplifier.

BACKGROUND OF THE INVENTION

The pulse tube cryocoolers do not have moving parts under a low temperature, and have advantages of a simple structure, low cost, low mechanical vibration, high reliability, and a long life. These advantages make the research of pulse tube cryocoolers popular. Compared with G-M type pulse tube cryocoolers, Stirling type pulse tube cryocooler is smaller and more compact, hence attracts more attention. As the enthalpy phase modulation theory indicates, the phase difference between the mass flow and the pressure wave can significantly affect the cooling performance of the pulse tube cryocooler. Thus, it is crucial to choose appropriate device for phase modulation. There are three kinds of phase modulation for pulse tube cryocoolers at present, namely the orifice, the double inlets and the inertance tube. Compared to the orifice, the inertance tube uses the inertance effect of the oscillating gas inside a long and thin tube to adjust the phase difference, which has better performance and wider range of phase modulation. Compared with the method of using double inlets, there are no direct current flows inside the inertance tube. This can eliminate the vibration at the cold end of the pulse tube caused by the direct current flow. Therefore, the inertance tube for phase modulation is better for Stirling type high-frequency pulse tube cryocoolers.

Researches by Radebaugh and some other people indicate that: when the phase of the mass flow and pressure wave in the middle of the regenerator is the same, the cooling efficiency of the pulse tube cryocooler is the highest. At the same time, at the hot end of the regenerator, the phase of the mass flow leads in advance the phase of the pressure wave about 30 degrees. And at the cold end, the phase of the pressure wave lags the phase of the mass flow about 30 degrees. These combined means that at the inlet of the inertance tube, the phase of the mass flow should lags the pressure wave about 60 degrees. Therefore, the inertance tube should be capable of at least 60 degrees of phase modulation. But for pulse tube cryocoolers which have smaller PV work, it is not realistic to realize that the phase of the mass flow lags the pressure wave about 60 degrees. Thus, it is urgently necessary to increase the acoustic power at the hot end of pulse tube and will improve the phase modulation capability of the inertance tube, in order to provide a proper angle for pulse tube cryocoolers.

For an ideal regenerator, the ratio of the acoustic power at the hot end to the acoustic power at the cold end is proportional to the ratio of the temperature at the hot end to the cold end. According to this principle, putting regenerative materials inside the pulse tube at proper position will function as an acoustic power amplifier for the cold end. This is the core content of the present invention, which will offer necessary phase modulation for the inertance tube at the hot end in the pulse tube.

DETAILED DESCRIPTION OF THE INVENTION

The object of the present invention is to overcome the shortcomings of present technology and provide an acoustic power amplifier for the phase modulation of the inertance tube and the pulse tube cryocooler.

The acoustic power amplifier for inertance tube phase modulation is: a metal tube filled its inside with regenerative materials, said tube being located at a distance X from the pulse tube; or regenerative materials inside the pulse tube, the regenerative materials having a length of L and a distance to the hot end of the pulse tube being X, satisfying the requirement of $X-L>0$.

A pulse tube cryocooler with an acoustic power amplifier consists of a first stage compressor, a first stage regenerator, a first stage pulse tube, a first stage acoustic power amplifier, a first stage inertance tube, and a first stage reservoir. The first stage compressor connects with the hot end of the first stage regenerator. The cold end of the first stage regenerator connects with the cold end of the first stage pulse tube. The hot end of the first stage pulse tube connects with the first stage reservoir through the first stage inertance tube. The first stage acoustic power amplifier is inside the first stage pulse tube. The distance between the first stage acoustic power amplifier and the hot end of the pulse tube is X. The length of the first stage acoustic power amplifier is L. $X-L>0$.

A pulse tube cryocooler with an acoustic power amplifier consists of a first stage compressor, a first stage regenerator, a first stage pulse tube, a first stage acoustic power amplifier, a first stage inertance tube, a first stage reservoir, a second stage compressor, a precooling section of second stage regenerator, a section of second stage regenerator, a second stage pulse tube, a second stage acoustic power amplifier, a second stage inertance tube, a second stage reservoir, and a thermal bridge. The first stage compressor connects of the hot end of the first stage regenerator. The cold end of the first stage regenerator connects with the cold end of the first stage pulse tube. The hot end of the first stage pulse tube connects with the first stage reservoir through the first stage inertance tube. The first stage acoustic power amplifier is inside the first stage pulse tube. The distance between the hot end of the first stage pulse tube and the first stage acoustic power amplifier is X. The length of the first stage acoustic power amplifier is L. $X-L>0$. The second stage compressor connects the hot end of the precooling section of the second stage regenerator. The cold end of the precooling section of the second stage connects with the hot end of the second stage regenerator. The cold end of the second stage regenerator connects with the cold end of the second stage pulse tube. The hot end of the second stage pulse tube connects with the second stage reservoir through the second stage inertance tube. The second stage acoustic power amplifier is inside the second stage pulse tube. The distance between the acoustic power amplifier and the hot end of the pulse tube is X. The length of the second stage acoustic power amplifier is L. $X-L>0$. The cold end of the precooling section of the second regenerator connects with the cold end of the first stage through a thermal bridge.

A pulse tube cryocooler with an acoustic power amplifier consists of a first stage pulse tube, a first stage acoustic power amplifier, a first stage inertance tube, a first stage reservoir, a second stage compressor, a precooling section of the second stage regenerator, a second stage regenerator, a second stage pulse tube, a second stage acoustic power amplifier, a second stage inertance tube, a second stage reservoir and a thermal bridge. The cold end of the first stage pulse tube connects with the precooling section of the second stage regenerator. The hot end of the first stage pulse tube connects with the first stage reservoir through the first stage inertance tube. The first stage acoustic power amplifier is inside the pulse tube. The distance between the first stage acoustic power amplifier and the hot end of the pulse tube is X. The length of the first stage acoustic power amplifier is L. X−L>0. The second stage compressor connects with the hot end of the precooling section of the second stage regenerator. The cold end of the precooling section of the second stage regenerator connects with the hot end of the second stage regenerator. The cold end of the second stage regenerator connects with the cold end of the second stage pulse tube. The hot end of the second stage pulse tube connects with the second stage reservoir through the second stage inertance tube. The second stage acoustic power amplifier is inside the second stage pulse tube. The distance between the acoustic power amplifier and the hot end of the second stage pulse tube is X. The length of the second stage acoustic power amplifier is L. X−L>0.

Beneficial Results

The present invention improves the performance of the cryocooler through the addition of acoustic power amplifier, which increases the acoustic power at the hot end of the pulse tube hence increase the angle of phase modulation of the inertance tube. For an ideal regenerator, the ratio of the acoustic power at the hot end to the acoustic power at the cold end is proportional to the ratio of the temperature at the hot end to the cold end. According to this principle, putting regenerative materials inside the pulse tube at a proper position will function as an acoustic power amplifier for the cold end. It is the core content of the present invention. This will offer the necessary phase modulation for the inertance tube at the hot end in the pulse tube.

DESCRIPTIONS OF THE DRAWINGS

FIG. 2 (*b*) shows a two-stage thermal-coupled pulse tube cryocooler with an acoustic power amplifier. Only the second stage adopts the acoustic power amplifier.

FIG. 3 (*b*) shows a two-stage gas-coupled pulse tube cryocooler with an acoustic power amplifier. Only the second stage adopts the acoustic power amplifier.

In the figures, C1 is the first stage linear compressor; RG1 is the first stage regenerator; PT1 is the first stage pulse; R1 is the first stage reservoir; I1 is the first stage inertance tube (ambient temperature); C2 is the second stage linear compressor; RG2 is the precooling section of the second stage regenerator; RG22 is the working section of the second stage regenerator; PT2 is the second stage pulse tube; R2 is the second stage reservoir (ambient temperature); I2 is the second stage inertance tube (ambient temperature); TB is a thermal bridge.

THE BEST IMPLEMENTATION EMBODIMENTS OF THE PRESENT INVENTION

The acoustic power amplifier for inertance tube phase modulation is: a metal tube filled its inside with regenerative materials, said tube being located at a distance X from the pulse tube; or regenerative materials inside the pulse tube, the regenerative materials having a length of L and a distance to the hot end of the pulse tube being X, satisfying the requirement of X−L>0.

Figure 1:
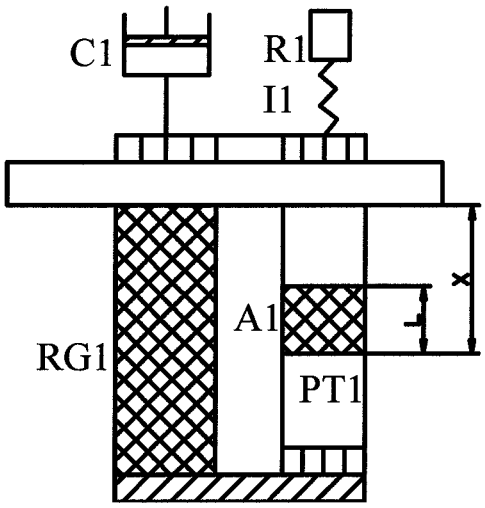
FIG. 1 shows a single stage pulse tube cryocooler with acoustic power amplifier and the acoustic power amplifier is at a proper position.

As shown in FIG. 1, a pulse tube cryocooler with an acoustic power amplifier consists of a first stage compressor C1, a first stage regenerator RG1, a first stage pulse tube PT1, a first stage acoustic power amplifier A1, a first stage inertance tube I1, and a first stage reservoir R1. The first stage compressor C1 connects with the hot end of the first stage regenerator RG1. The cold end of the first stage regenerator RG1 connects with the cold end of the first stage pulse tube PT1. The hot end of the first stage pulse tube PT1 connects with the first stage reservoir R1 through the first stage inertance tube I1. The first stage acoustic power amplifier A1 is inside the first stage pulse tube PT1. The distance between the first stage acoustic power amplifier A1 and the hot end of the pulse tube is X. The length of the first stage acoustic power amplifier A1 is L. X−L>0.

Figure 2:
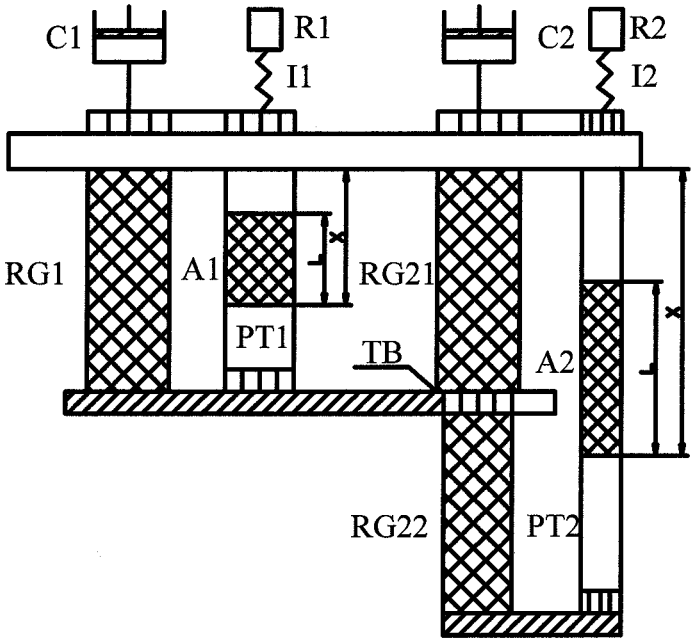
FIG. 2 (*a*) shows a two-stage thermal-coupled pulse tube cryocooler with an acoustic power amplifier. Both the first stage and the second stage adopt the acoustic power amplifier.
Figure 2:
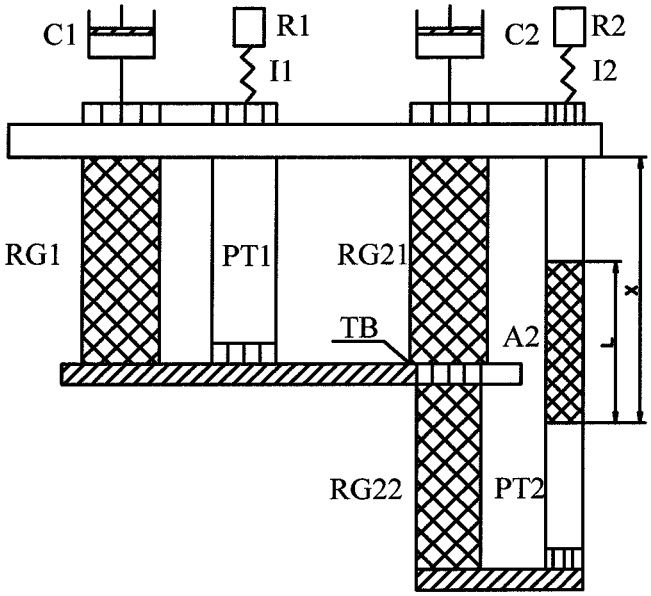

As shown in FIG. 2, a pulse tube cryocooler with an acoustic power amplifier consists of a first stage compressor C1, a first stage regenerator RG1, a first stage pulse tube PT1, a first stage acoustic power amplifier A1, a first stage inertance tube I1, a first stage reservoir R1, a second stage compressor C2, a precooling section of second stage regenerator RG21, a section of second stage regenerator RG22, a second stage pulse tube PT2, a second stage acoustic power amplifier A2, a second stage inertance tube I2, a second stage reservoir R2, and a thermal bridge TB. The first stage compressor C1 connects with the hot end of the first stage regenerator RG1. The cold end of the first stage regenerator RG1 connects with the cold end of the first stage pulse tube PT1. The hot end of the pulse tube PT1 connects with the first stage reservoir R1 through the first stage inertance tube I1. The first stage acoustic power amplifier A1 is inside the first stage pulse tube PT1. The distance between the hot end of the first stage pulse tube PT1 and the first stage acoustic power amplifier A1 is X. The length of the first stage acoustic power amplifier A1 is L. X−L>0. The second stage compressor C2 connects the hot end of the precooling section of the second stage regenerator RG21. The cold end of the precooling section of the second stage connects RG21 with the hot end of the second stage regenerator RG22. The cold end of the second stage regenerator RG22 connects with the cold end of the second stage pulse tube PT2. The hot end of the second stage pulse tube PT2 connects with the second stage reservoir R2 through the second stage inertance tube I2. The second stage acoustic power amplifier A2 is inside the second stage pulse tube PT2. The distance between the acoustic power amplifier A2 and the hot end of the pulse tube PT2 is X. The length of the second stage acoustic power amplifier A2 is L. X−L>0. The cold end of the precooling section of the second regenerator RG2 connects with the cold end of the first stage through a thermal bridge TB.

Figure 3:
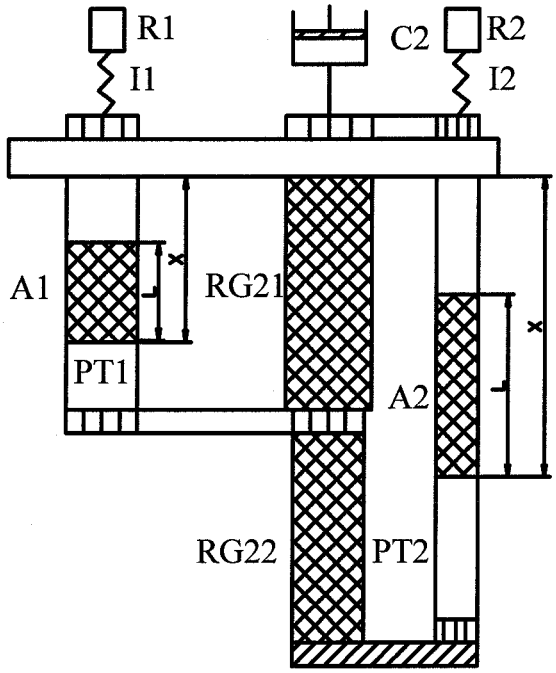
FIG. 3 (*a*) shows a second stage gas-coupled pulse tube cryocooler with an acoustic power amplifier. Both the first stage and the second stage adopt the acoustic power amplifier.
Figure 3:
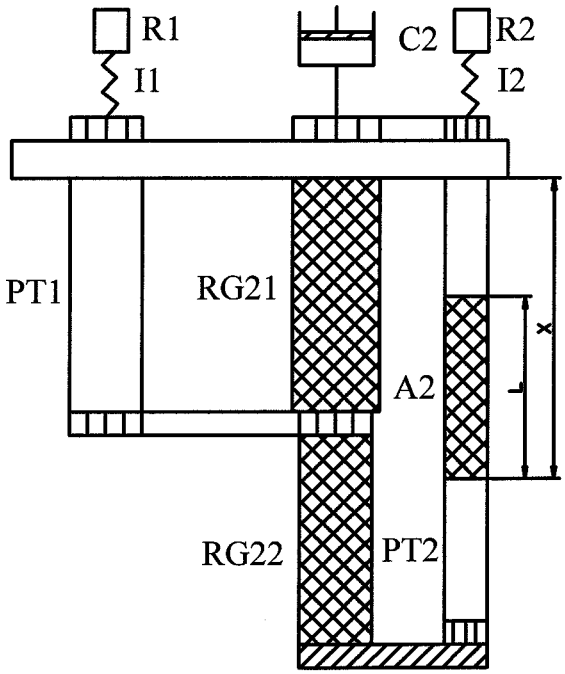

As shown in FIG. 3, a pulse tube cryocooler with an acoustic power amplifier consists of a first stage pulse tube PT1, a first stage acoustic power amplifier A1, a first stage inertance tube I1, a first stage reservoir R1, a second stage compressor C2, a precooling section of the second stage regenerator RG21, a second stage regenerator RG22, a second stage pulse tube PT1, a second stage acoustic power amplifier A2, a second stage inertance tube I2, a second stage reservoir R2, and a thermal bridge TB. The cold end of the first stage pulse tube PT1 connects with the precooling section of the second stage regenerator RG21. The hot end of the first stage pulse tube PT1 connects with the first stage reservoir R1 through the first stage inertance tube I1. The first stage acoustic power amplifier A1 is inside the pulse tube. The distance between the first stage acoustic power amplifier A1 and the hot end of the pulse tube PT1 is X. The length of the first stage acoustic power amplifier A1 is L. X−L>0. The second stage compressor C2 connects with the hot end of the precooling section of the second stage regenerator RG21. The cold end of the precooling section of the second stage regenerator RG21 connects with the hot end of the second stage regenerator RG22. The cold end of the second stage regenerator RG22 connects with the cold end of the second stage pulse tube PT2. The hot end of the second stage pulse tube PT2 connects with the second stage reservoir R2 through the second stage inertance tube I2. The second stage acoustic power amplifier A2 is inside the second stage pulse tube PT2. The distance between the acoustic power amplifier A2 and the hot end of the second stage pulse tube PT2 is X. The length of the second stage acoustic power amplifier A2 is L. X−L>0.

In summary, the present invention includes two main parts. The first part is an acoustic power amplifier which is characterized as a metal tube filled with regenerative materials. The acoustic power amplifier can be inside the pulse tube and the distance between the acoustic power amplifier and the hot end of the pulse tube is X. Alternatively, the filling regenerative materials inside the pulse tube, whose length is L and distant X from the hot end, forms an acoustic power amplifier, where X−L>0. The second part is the acoustic power amplifier can be used separately or correspondently in single or multi stage thermal-coupled or gas-coupled pulse tube cryocoolers. The length L of acoustic power amplifier can be freely chosen according to specific requirements.

A comparison is offered below to illustrate the advantages of acoustic power amplifier for phase modulation in inertance tube. Three Stirling type high-frequency pulse tube cryocooler working at 35K are selected, one adopting an ambient temperature inertance tube for phase modulation, another adopting a low temperature inertance tube for phase modulation, and still another adopting an ambient temperature inertance tube with acoustic power amplifier for phase modulation. The acoustic power amplifier in the third one locates in the middle ⅓ of the pulse tube. Assuming the frequency is 40 Hz, charging pressure is 1.25 MP; adiabatic temperature at the hot end is 300 k. The volume of the reservoir is infinite. Pressure ratio of the cold end is 1.15.

| System | Acoustic power[1] | Acoustic power[2] | Pressure ratio[3] | Phase difference[4] | Remarks |
|---|---|---|---|---|---|
| A two stage high frequency Stirling type pulse tube cryocooler working at 35 K with cold inertance tube for phase modulation | 2 W | 2 W | about 1.15 | about 70-80° | The second stage inertance tube and the reservoir is at the position where temperature is 80 K, phase modulation angle being relatively large, fully qualified for phase modulation; but low temperature inertance tube is too complicated in structure and too difficult to manage |
| A two stage high frequency Stirling type pulse tube cryocooler working at 35 K with ambient temperature inertance tube for phase modulation | 2 W | 2 W | about 1.15 | about 16° | Phase modulation difference is too small to satisfy the requirement of the system. |
| A two stage high frequency Stirling type pulse tube cryocooler working at 35 K with ambient temperature inertance tube including acoustic power amplifier for phase modulation | 2 W | 10 W | about 1.10 | about 60° | With an acoustic power amplifier, the pressure ratio decreases while the acoustic power increases, both benefit phase modulation and the difference of phase modulation meet the requirement; the whole phase modulation instrument is in an ambient temperature, avoiding the complexity of low temperature phase modulation |

[1]Acoustic power at the cold end of the pulse tube;

[2]Acoustic power the hot end of the pulse tube

[3]Pressure ratio at the hot end of the pulse tube;

[4]Phase difference provided by the inertance tube

From the above calculation, adding acoustic power amplifier not only improve the acoustic power at the hot end of pulse tube significantly but also decrease the pressure ratio, both of which benefit phase modulation of the system while avoiding the complexity of low temperature phase modulation.

The Implementation of The Present Invention

INDUSTRY UTILITY

Sequence Table Free Content

The invention claimed is:

1. An acoustic power amplifier used in an inertance tube phase modulation, characterized in that a metal tube filled with regenerative materials, is located at a distance of X from a hot end of a pulse tube, or that the regenerative materials is located at an internal part of the pulse tube with a distance of X from the hot end of the pulse tube, with a length of L, X−L>0.

2. A pulse tube cryocooler with acoustic power amplifier, characterized in that it comprises a first stage compressor (RG1), a first stage pulse tube (PT1), a first stage acoustic power amplifier (A1), an inertance tube (I1), and a reservoir; wherein a first stage compressor (C1) connects with a hot end of the first stage regenerator (RG1); a cold end of the first stage regenerator (RG1) connects with a cold end of the first stage pulse tube (PT1); a hot end of the first stage pulse tube (PT1) connects with a first stage reservoir (R1) through the first stage inertance tube (I1); the first stage acoustic power amplifier (A1) locates inside the first stage pulse tube (PT1), at the position with a distance X from the hot end of the first stage pulse tube (PT1), the length of the first stage acoustic power amplifier is L, X−L>0.

3. A pulse tube cryocooler with an acoustic power amplifier, characterized in that it includes a first stage compressor (C1), a first stage regenerator (RG1), a first stage pulse tube (PT1), a first stage acoustic power amplifier (A1), an inertance tube (I1), a first stage reservoir (R1), a second stage compressor (C2), a precooling section of second stage regenerator (RG21), a second stage regenerator (RG22), a second stage pulse tube (PT1), a second stage acoustic amplifier (A2), a second inertance tube (I2), a second stage reservoir (R2), and a thermal bridge (TB); wherein the first stage compressor (C1) connects with a hot end of the first stage regenerator (RG1); a cold end of the first stage regenerator (RG1) connects with the cold end of the first stage pulse tube (PT1); the hot end of the first stage pulse tube (PT1) connects with the first stage reservoir (R1) through the first stage inertance tube; the first stage acoustic power amplifier (A1) locates inside the first stage pulse tube (PT1); the distance between the first stage acoustic power amplifier and the hot end of the pulse tube is X, the length of the first stage acoustic amplifier is L, X−L>0; the second stage compressor (C2) connects with the hot end of the second stage regenerator (RG21); the cold end of the precooling section of the second stage regenerator (RG21) connects with the hot end of the second stage regenerator (RG22); the cold end of the second stage regenerator (RG22) connects with the cold end of the second stage pulse tube (PT2), the hot end of the second stage pulse tube (PT2) connects with the second stage reservoir (R2) through the second stage inertance tube; the second stage acoustic power amplifier (A2) is inside the second stage pulse tube (PT2), the distance between the hot end of the second stage pulse tube (PT2) and the second stage acoustic power amplifier (A2) is X, the length of the second stage acoustic power amplifier (A1) is L, and X−L>0; the cold end of the precooling section of the second stage regenerator (RG21) connects with the cold end of the first stage through the thermal bridge.

4. A pulse tube cryocooler with an acoustic power amplifier, characterized in that it includes a first stage pulse tube (PT1), a first stage acoustic power amplifier (A1), an inertance tube (I1), a first stage reservoir (R1), a second stage compressor (C2), a precooling section of second stage regenerator (RG21), a second stage regenerator (RG22), a second stage pulse tube (PT1), a second stage acoustic amplifier (A2), a second inertance tube (I2), a second stage reservoir (R2), and a thermal bridge (TB); wherein a cold end of the first stage pulse tube (PT1) connects with a hot end of the precooling section of the second stage regenerator (RG21); a hot end of the first stage pulse tube (PT1) connects with the first stage reservoir (R1) through the first stage inertance tube (I1); the first stage acoustic power amplifier (A1) is inside the first stage pulse tube (PT1); the distance between the first stage acoustic power amplifier (A1) and a hot end of the first stage pulse tube (PT1) is X, the length of the first stage acoustic amplifier (A1) is L, X−L>0; the second stage compressor (C2) connects with the hot end of the precooling section of the second stage regenerator (RG21); a cold end of the precooling section of the second stage regenerator (RG21) connects with the hot end of the second stage regenerator (RG22); a cold end of the second stage regenerator (RG22) connects with a cold end of the second stage pulse tube (PT2); a hot end of the second stage pulse tube (PT2) connects with the second stage reservoir (R2) through the second stage inertance tube (I2); the second stage acoustic power amplifier (A2) is inside the second stage pulse tube (PT2); the distance between the second stage acoustic power amplifier (A2) and the hot end of the second stage pulse tube (PT2) is X, the length of the second stage acoustic power amplifier (A1) is L, X−L>0.

* * * * *